US009715208B2

(12) United States Patent
Uchida

(10) Patent No.: US 9,715,208 B2
(45) Date of Patent: Jul. 25, 2017

(54) CONTACT SPRING AND IMAGE FORMING APPARATUS

(71) Applicant: KONICA MINOLTA, INC., Chiyoda-ku, Tokyo (JP)

(72) Inventor: Satomi Uchida, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/995,455

(22) Filed: Jan. 14, 2016

(65) Prior Publication Data

US 2016/0216680 A1 Jul. 28, 2016

(30) Foreign Application Priority Data

Jan. 22, 2015 (JP) ..... 2015-010555

(51) Int. Cl.

| | |
|---|---|
| ***G03G 21/16*** | (2006.01) |
| ***G03G 15/00*** | (2006.01) |
| ***G03G 21/18*** | (2006.01) |
| ***H01R 4/48*** | (2006.01) |
| ***H01R 13/33*** | (2006.01) |

(52) U.S. Cl.

CPC ..... *G03G 15/80* (2013.01); *G03G 21/1652* (2013.01); *G03G 21/1867* (2013.01); *H01R 4/48* (2013.01); *H01R 13/33* (2013.01)

(58) Field of Classification Search

CPC ..... G03G 15/80; G03G 21/1867; G03G 21/1652; H01B 5/04; H01R 4/48

See application file for complete search history.

(56) References Cited

U.S. PATENT DOCUMENTS

| | | | | |
|---|---|---|---|---|
| 7,450,878 | B2 | 11/2008 | Yano | |
| 8,346,118 | B2 | 1/2013 | Itabashi | |
| 2015/0378303 | A1* | 12/2015 | Ohata | G03G 21/1652 399/90 |

FOREIGN PATENT DOCUMENTS

| | | | |
|---|---|---|---|
| JP | 2007-3925 | A | 1/2007 |
| JP | 2008242070 | A | * 10/2008 |
| JP | 2009-110996 | A | 5/2009 |
| JP | 2010-79135 | A | 4/2010 |
| JP | 2011-134601 | A | 7/2011 |

OTHER PUBLICATIONS

Office Action (Notice of Reasons for Rejection) issued Jan. 31, 2017 by the Japanese Patent Office in corresponding Japanese Patent Application No. 2015-010555, and English translation of Office Action (19 pages).

* cited by examiner

*Primary Examiner* — David M Gray
*Assistant Examiner* — Laura Roth
(74) *Attorney, Agent, or Firm* — Buchanan Ingersoll & Rooney PC

(57) ABSTRACT

A contact spring is constituted by a bare wire and accommodated in a bent groove of a wire support guide. A non-linear connection is realized via the bare wire between two parts disposed apart from each other within an image forming apparatus. One end of the contact spring is connected with one of the two parts, the other end of the contact spring is connected with the other part via the bent groove, and a coil-shaped or zigzag-shaped elastic portion of the bare wire is in a portion accommodated in the bent groove.

13 Claims, 12 Drawing Sheets

CONTACT SPRING AND IMAGE FORMING APPARATUS

The entire disclosure of Japanese Patent Application No. 2015-010555 filed on Jan. 22, 2015 including description, claims, drawings, and abstract are incorporated herein by reference in its entirety.

BACKGROUND OF THE INVENTION

Field of the Invention

The present invention relates to a contact spring constituted by a bare wire and realizing connection between two parts disposed apart from each other in an image forming apparatus, and an image forming apparatus including this contact spring.

Description of the Related Art

An image forming apparatus such as a printer is configured to supply power from a power supply board included in an apparatus body to an imaging unit containing a photosensitive drum, a charger, a developing unit and others via wires. Generally, the power supply board is often disposed at a position away from the imaging unit by a certain distance for reasons of apparatus design. Accordingly, the wires between the power supply board and the imaging unit are supported by a wire support member to prevent hanging of the wire between the power supply board and the imaging unit.

Each of these wires may be constituted by a wire harness including a linear conductive member such as copper, and an insulator such as resin for covering the conductive member. However, the wire harness is generally a high-cost component. Particularly, a wire having a large diameter for receiving a high charging voltage or the like may remarkably raise costs.

For overcoming this problem, there has been proposed a configuration which connects a terminal of a power supply board and a terminal of an imaging unit by using a so-called contact spring. This contact spring is a bare wire such as a stainless steel wire not covered with insulation coating, as a less expensive wire than the wire harness. For example, see JP 2009-110996 A.

When the linear contact spring not covered with insulation coating is routed between the power supply board and the imaging unit, the contact spring is fitted into a groove of an insulating wire support member made of resin or the like, based on the necessity for avoiding short-circuiting with a frame or the like of the apparatus body.

The groove of the wire support member is often bent at a plurality of points in the route between the power supply board and the imaging unit, depending on the positions of the power supply board and the imaging unit. The contact spring is manufactured into a shape having bent portions in a length direction beforehand by bending or other methods in accordance with the shape of the bent groove.

The contact spring is generally manufactured by a process for sequentially bending a linear hard stainless steel wire at each point, i.e., by a process which forms a bent portion by bending the wire at a point and then forms a subsequent bent portion by bending the wire at a subsequent point. In this case, a bending start position corresponding to a bending start of each banded bent portion is easily variable.

More specifically, each bent portion includes a dimensional tolerance. For example, when a bending start position of a second bent portion is shifted by an amount of a dimensional tolerance from a forming position of an initial banded bent portion, a shift by an amount of a dimensional tolerance from a forming position of the second bent portion is further added to the previous shift amount. Similarly, a start position of a third or further bent portion is shifted by a total shift amount of the previous banded bent portions. When shift amounts of respective forming positions are sequentially added in accordance with increase in the number of bent portions, each of the manufactured contact springs may include some variations in the forming positions of the respective bent portions.

Accordingly, even when a bent portion of a certain contact spring is easily fitted by an operator into a bent groove of a wire support member during an assembly step of a manufacture line or the like of an image forming apparatus, a bent portion of another contact spring may be shifted from the position of the tended bent groove due to a variation of the forming position of the bent portion. In this case, a fitting process is difficult to perform.

The operator may continue the process by slightly pulling the contact spring to complete fitting. However, when fitting in this manner is difficult, the operator needs to remove the contact spring from the wire support guide and again fit the contact spring while stopping the process. Alternatively, the operator needs to replace the contact spring with a new contact spring and again fit the new contact spring from the start of fitting. These necessities may lower assembly efficiency.

The foregoing problems occur not only from the structure connecting the power supply board and the imaging unit via the contact spring, but also from a structure connecting other two parts provided on the image forming apparatus.

SUMMARY OF THE INVENTION

The present invention has been developed to solve the aforementioned problems, and an object thereof is to provide a contact spring capable of improving assembly efficiency, and an image forming apparatus including this contact spring.

To achieve the abovementioned object, according to an aspect, a contact spring constituted by a bare wire and accommodated in a bent groove of a wire support guide, realizing non-linear connection via the bare wire between two parts disposed apart from each other within an image forming apparatus, in such a manner that one end of the contact spring is connected with one of the two parts, and that the other end of the contact spring is connected with the other part via the bent groove, the contact spring reflecting one aspect of the present invention comprises a coil-shaped or zigzag-shaped elastic portion of the bare wire in a portion accommodated in the bent groove.

The elastic portion is preferably a coil wound in a spiral shape, and accommodated in the bent groove while elastically bent by external force.

Bare wire portions of the contact spring on both sides of the elastic portion are preferably linear. An axial center of the elastic portion is preferably aligned with the both-side bare wire portions in a line in a natural state without application of external force.

The wire support guide preferably includes the three or more bent grooves. Bare wire portions accommodated in the two bent grooves positioned in the vicinity of the two parts and corresponding to the bent grooves other than the bent groove in which the elastic portion is preferably accommodated are bended beforehand in accordance with bent shapes of the two bent grooves.

At least one of both ends of the bare wire preferably has a coil shape, and connects with the corresponding part by elastic urging force.

The elastic portion is preferably a coil wound in a spiral shape. An average coil diameter of the elastic portion is preferably smaller than an average coil diameter of the bare wire positioned at one end of the bare wire and formed in the coil shape.

The wire support guide preferably includes the three or more bent grooves. When a distance between two adjoining bent grooves included in the bent grooves other than the bent groove in which the elastic portion is accommodated is shorter than a predetermined value, a bare portion accommodated in each of the two adjoining bent grooves is preferably bended beforehand in accordance with the bent shape of the corresponding bent groove.

An image forming apparatus preferably comprises: two parts associated with image formation; a wire support guide that includes a bent groove in a part of the wire support guide; and the single contact spring described above, constituted by a bare wire for realizing connection via the bent groove, in such a manner that one end of the contact spring is connected with one of the two parts, and that the other end of the contact spring is connected with the other part via the bent groove.

A plurality of pairs of parts are preferably provided. The single contact spring is preferably separately provided for each of the plurality of pairs. The wire support guide preferably includes the bent grooves separately for each of the pairs. A first bent groove and a second bent groove included in the plurality of bent grooves are disposed in parallel with each other in a state that a curvature of the first bent groove is preferably larger than a curvature of the second bent groove. An elastic portion of a first contact spring is preferably accommodated in the first bent groove, while an elastic portion of a second contact spring is preferably accommodated in the second bent groove. Each of the elastic portions of the first and second contact springs is preferably a coil wound in a spiral shape. A total number of windings of the elastic portion of the first contact spring is preferably larger than a total number of windings of the elastic portion of the second contact spring.

A plurality of pairs of parts are preferably provided. The single contact spring is preferably separately provided for each of the plurality of pairs. The wire support guide preferably includes the bent grooves separately for each of the pairs. A first bent groove and a second bent groove included in the plurality of bent grooves are preferably disposed in parallel with each other in a state that a curvature of the first bent groove is larger than a curvature of the second bent groove. An elastic portion of a first contact spring is preferably accommodated in the first bent groove, while an elastic portion of a second contact spring is preferably accommodated in the second bent groove. Each of the elastic portions of the first and second contact springs is preferably a coil wound in a spiral shape. A total number of windings of the coil of the elastic portion of the first contact spring is preferably equivalent to a total number of windings of the coil of the elastic portion of the second contact spring, with a smaller pitch of the coil of the elastic portion of the first contact spring than a pitch of the coil of the elastic portion of the second contact spring.

The wire support guide preferably includes a plurality of the bent grooves. The single contact spring connecting the two parts via the plurality of bent grooves preferably includes the elastic portion in each of portions of the bare wire accommodated in the respective bent grooves. A curvature of a first bent groove included in the plurality of bent grooves is preferably larger than a curvature of a second bent groove included in the plurality of bent grooves. A first elastic portion included in the plurality of elastic portions of the single contact spring is preferably accommodated in the first bent groove, while a second elastic portion included in the plurality of elastic portions of the single contact spring is preferably accommodated in the second bent groove. Each of the first and second elastic portions is preferably a coil wound in a spiral shape. A total number of windings of the first elastic portion is preferably larger than a total number of windings of the second elastic portion.

The image forming apparatus preferably further comprises a projection disposed in the bent groove of the wire support guide to prevent rise and separation of the contact spring accommodated in the bent groove to the outside from the bent groove.

The image forming apparatus preferably further comprises: an image carrier; a charger that charges the image carrier; an exposure unit that applies optical beams to the charged image carrier to form an electrostatic latent image; a developing unit that develops the electrostatic latent image formed on the image carrier by using developer; and a power supply unit that supplies a bias voltage to each of the charger and the developing unit. One of the parts preferably corresponds to the power supply unit. The other part preferably corresponds to the charger or the developing unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8A is a cross-sectional view taken along a line A-A in FIG. 7, while

DESCRIPTION OF THE PREFERRED EMBODIMENTS

Hereinafter, an embodiment of the present invention will be described with reference to the drawings. However, the scope of the invention is not limited to the illustrated examples.

A contact spring and an image forming apparatus according to an embodiment of the present invention are hereinafter described, based on an application example of a color printer (hereinafter abbreviated as "printer").

(1) Configuration of Printer

Figure 1:
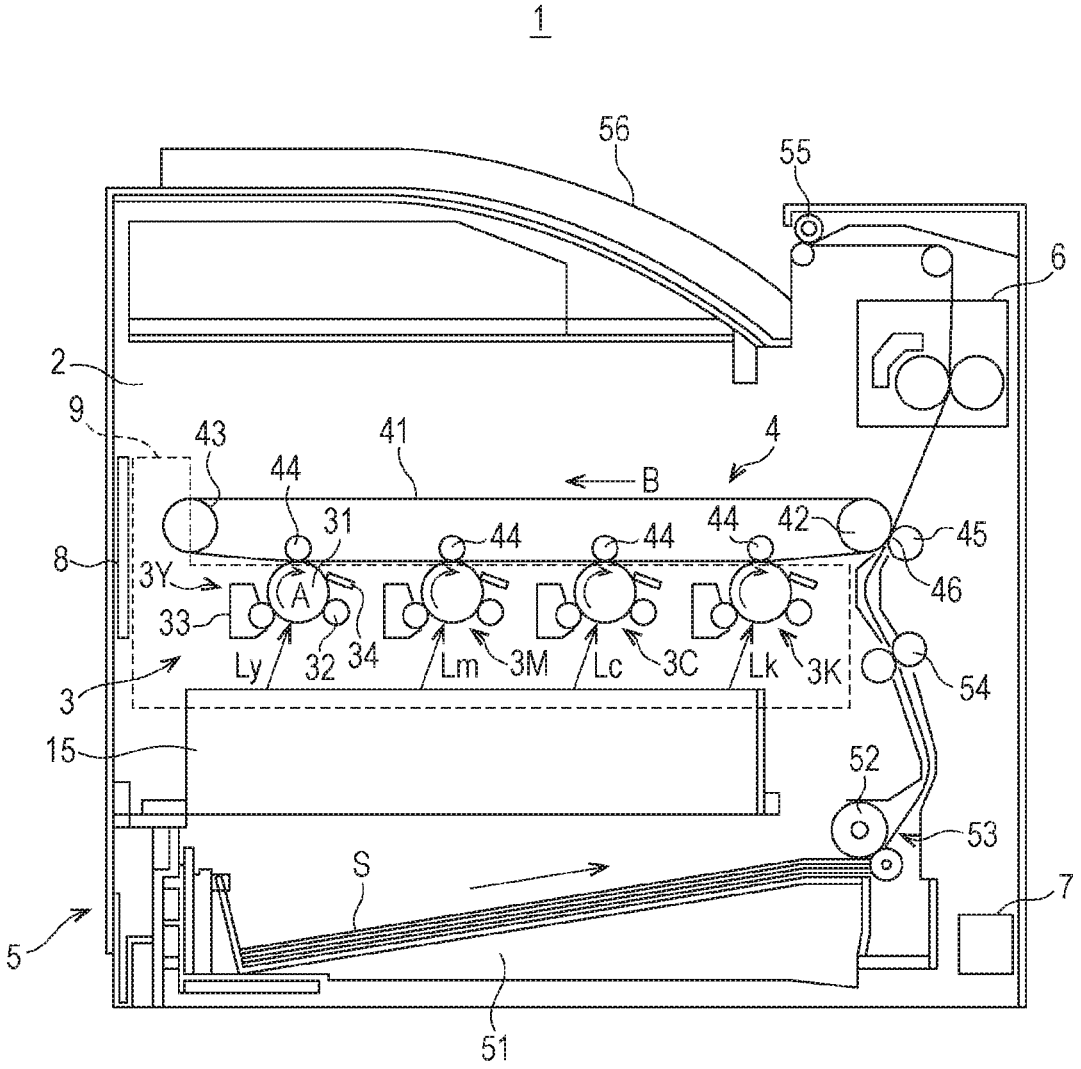
FIG. 1 is a view illustrating a configuration of a printer according to an embodiment.

FIG. 1 is a schematic front view illustrating a configuration of a printer 1 according to this embodiment.

As illustrated in this figure, the printer 1 includes an image forming unit 3, an intermediate transfer unit 4, a feed unit 5, a fixation unit 6, a control unit 7, a high-voltage power supply board 8, and others.

The printer 1 is connected with a network (such as LAN). When receiving an instruction for executing a print job from an external terminal device (not shown), the printer 1 forms toner images in yellow, magenta, cyan, and black based on the instruction, and transfers these toner images to a recording sheet by multiple transfer to form a color image. The respective reproduction colors of yellow, magenta, cyan, and black are hereinafter abbreviated as Y, M, C, and K. These abbreviations are added as subscripts to reference numbers of constituent elements associated with the corresponding reproduction colors.

The image forming unit 3 is disposed substantially at a central portion of an apparatus body 2 in the up-down and left-right directions as viewed from the device front side. The image forming unit 3 includes imaging units 3Y, 3M, 3C, and 3K, an exposure unit 15, and others.

The imaging unit 3Y includes a photosensitive drum 31 which rotates in a direction indicated by an arrow A, a charger 32, a developing unit 33, and a cleaner 34 for cleaning the photosensitive drum 31, and others, all of which components 32, 33, and 34 are disposed around the photosensitive drum 31. The imaging unit 3Y forms a toner image in Y color on the photosensitive drum 31. While the photosensitive drum 31 functions as an image carrier in this configuration, a photosensitive belt may perform this function instead of the photosensitive drum 31.

Each of the other imaging units 3M through 3K has a configuration basically similar to the configuration of the imaging unit 3Y, and forms a toner image in the corresponding color on the photosensitive drum 31. Reference numbers of respective components provided on the imaging units 3M through 3K are not shown in the figure.

The intermediate transfer unit 4 disposed above the imaging units 3Y through 3K includes an intermediate transfer belt 41, a driving roller 42, a driven roller 43, primary transfer rollers 44, a secondary transfer roller 45, and others.

The intermediate transfer belt 41 is wound around the driving roller 42, the driven roller 43, and the four primary transfer rollers 44, and circulated in a direction indicated by an arrow B.

Each of the four primary transfer rollers 44 is so disposed as to face the corresponding photosensitive drum 31 of the imaging units 3Y through 3K with the intermediate transfer belt 41 interposed between the primary transfer roller 44 and the photosensitive drum 31. The secondary transfer roller 45 is so disposed as to face the driving roller 42 with the intermediate transfer belt 41 interposed between the secondary transfer roller 45 and the driving roller 42.

The exposure unit 15 disposed below the imaging units 3Y through 3K emits optical beams Ly, Lm, Lc, and Lk from light emission elements to form images in Y, M, C, and K colors in response to driving signals received from the control unit 7, and applies the optical beams Ly, Lm, Lc, and Lk to the photosensitive drums 31 charged by the chargers 32 for exposure scanning for each of the imaging units 3Y, 3M, 3C, and 3K. By this exposure scanning, electrostatic latent images are formed on the respective photosensitive drums 31 of the imaging units 3Y through 3K.

The electrostatic latent images formed on the photosensitive drums 31 for each of the imaging units 3Y through 3K are developed by using developer, such as toner, contained in the developing units 33 to form toner images in corresponding colors on the photosensitive drums 31.

The toner images formed on the respective photosensitive drums 31 are transferred to the intermediate transfer belt 41 by primary transfer by using the primary transfer rollers 44 facing the photosensitive drums 31 via the intermediate transfer belt 41. In the primary transfer, image forming timing of each of the toner images formed on the imaging units 3M through 3K is shifted from a reference of image forming timing of the imaging unit 3Y by a predetermined time, such that the toner images in the respective colors are overlapped with each other at the same position on the intermediate transfer belt 41. Based on this control, a color toner image is formed on the intermediate transfer belt 41.

The feed unit 5 includes a feed cassette 51 storing recording sheets S, a feed roller 52 for feeding the sheets S stored in the feed cassette 51 one by one onto a conveyance path 53, a timing roller 54 for conveying the fed sheet S to a secondary transfer position 46 corresponding to a contact position between the secondary transfer roller 45 and the intermediate transfer belt 41 at appropriate timing, and others.

The timing roller 54 conveys the sheet S to the secondary transfer position 46 at the timing when respective toner images transferred to the intermediate transfer belt 41 by multiple transfer are conveyed to the secondary transfer position 46. When the sheet S passes through the secondary transfer position 46, the toner images in respective colors formed on the intermediate transfer belt 41 are collectively transferred to the sheet S by secondary transfer by using the secondary transfer roller 45. The sheet S to which the toner images in respective colors have been transferred by secondary transfer is conveyed to the fixation unit 6.

The fixation unit 6 disposed above the intermediate transfer unit 4 heats and pressurizes the toner images in respective colors (not-fixed images) on the sheet S conveyed from the secondary transfer roller 45 to thermally fix the toner images to the sheet S. The sheet S having passed through the fixation unit 6 is discharged toward a discharge tray 56 by a discharge roller 55.

The high-voltage power supply board 8 disposed on the left side of the apparatus body 2 as viewed from the apparatus front side converts power supplied from a commercial power supply into predetermined high voltage direct current (DC) or high voltage alternating current (AC), and outputs the converted voltage to the charger 32 and the developing unit 33 of each of the imaging units 3Y through 3K.

According to this embodiment, a charging bias voltage necessary for charging in a range from DC −1 kV to DC −2 kV, for example, is output to the charger 32. On the other hand, a developing bias voltage necessary for developing in a range from DC −300V to DC −500V, for example, is output to the developing unit 33.

Each of the bias voltages is supplied through a plurality of wires electrically connecting the high-voltage power supply board 8 and the imaging units 3Y through 3K. Each of these wires is a contact spring (FIG. 3) constituted by a metal wire not covered with insulation coating (bare wire). According to this embodiment, the charger 32 and the developing unit 33 are provided for each of the imaging units 3Y through 3K (i.e., the sum of the chargers 32 and developing units 33 is eight). The bias voltage is supplied from the high-voltage power supply board 8 to each of the chargers 32 and the developing units 33. Accordingly, the number of the contact springs is eight in total. The structure of the contact springs will be described below.

A wire support guide 9 (indicated by a broken line) for supporting the plurality of contact springs is disposed on the apparatus rear side with respect to the imaging units 3Y through 3K. The wire support guide 9 is a plate-shaped component made of insulating material, such as resin as in this embodiment.

The wire support guide 9 has guide grooves (described below) for each of the contact springs with one-to-one correspondence. The single contact spring is fitted and accommodated in the corresponding guide groove. This structure prevents short-circuiting caused by contact between the contact spring not covered with insulation coating and a frame or the like of the apparatus body 2.

(2) (Configuration of Control Unit)

Figure 2:
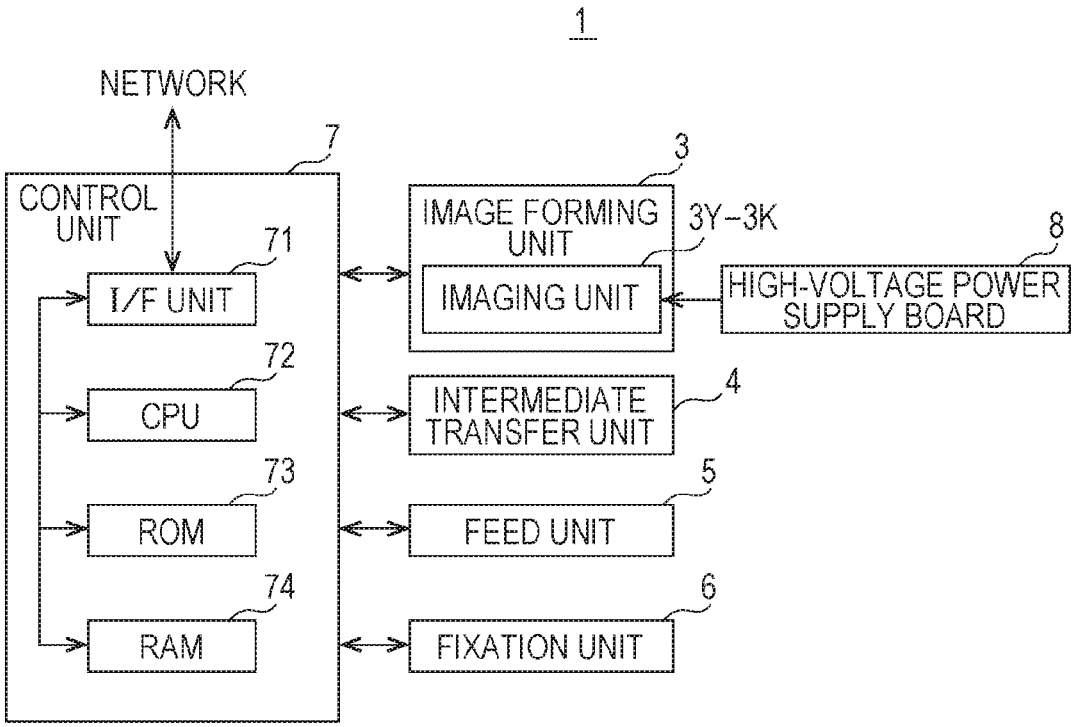
FIG. 2 is a block diagram illustrating a configuration of a control unit included in the printer.

FIG. 2 is a block diagram illustrating a configuration of the control unit 7.

As illustrated in this figure, the control unit 7 includes a communication interface (I/F) unit 71, a CPU 72, a ROM 73, a RAM 74 and others, each of which components 71 through 74 communicate with the other components.

The communication I/F unit 71 is an interface such as a LAN card and a LAN board for connection with a LAN, for example, and communicates with an external terminal device connected with the communication I/F unit 71 via a network.

The CPU 72 reads necessary programs from the ROM 73, and controls the image forming unit 3, the intermediate transfer unit 4, the feed unit 5, and the fixation unit 6 under the programs for smooth execution of a print job. The RAM 74 is provided as a work area for the CPU 72.

Each of the imaging units 3Y through 3K receives charging bias voltage and developing bias voltage output from the high-voltage power supply board 8. The charger 32 having received the charging bias voltage charges the surface of the photosensitive drum 31 at a predetermined potential. The developing unit 33 having received the developing bias voltage develops an electrostatic latent image formed on the photosensitive drum 31 using toner to visualize the electrostatic latent image.

(3) Structure of Contact Spring

Figure 3:
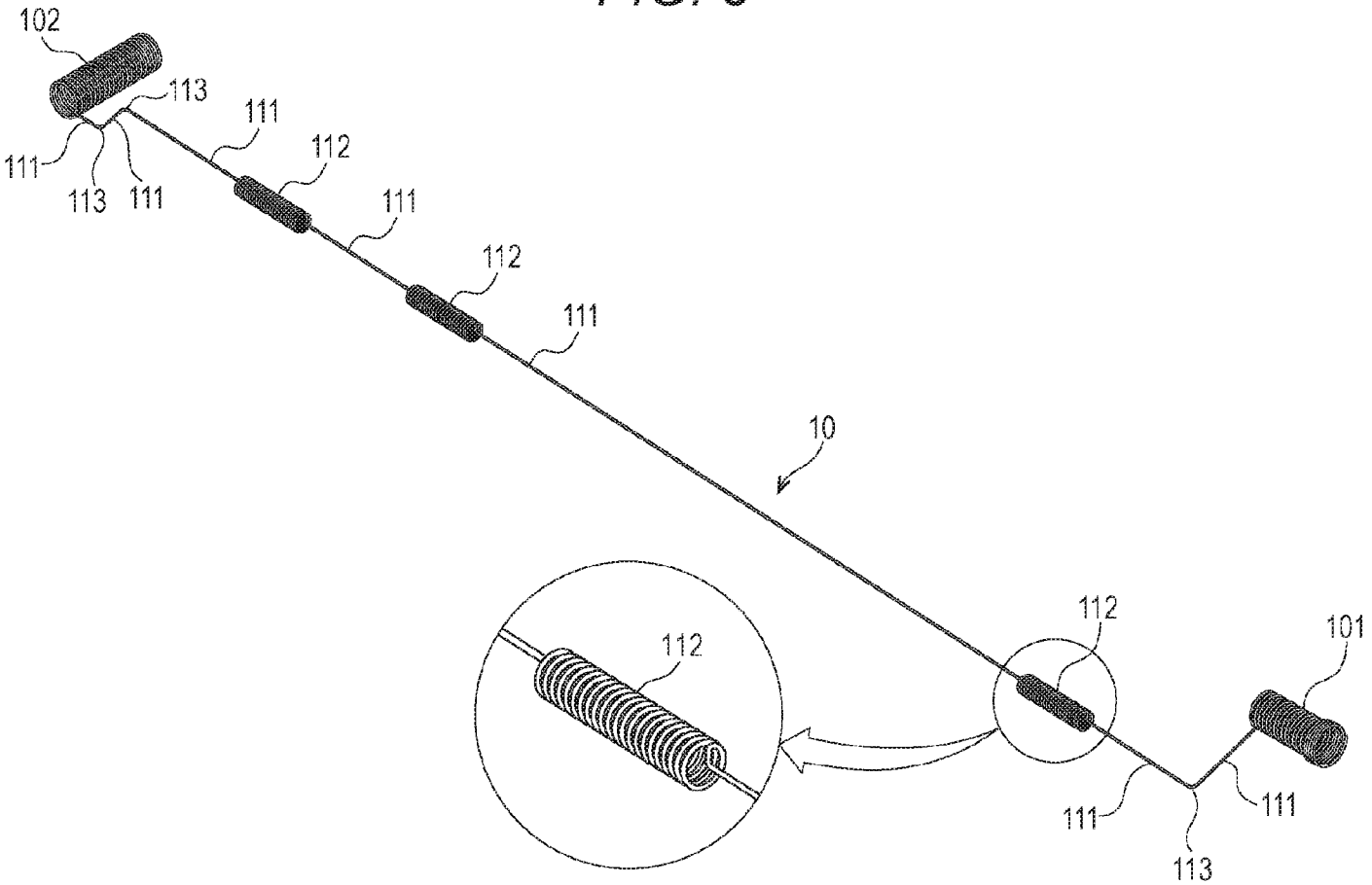
FIG. 3 is a perspective view illustrating a state of a single contact spring removed from a wire support guide.

FIG. 3 is a perspective view illustrating a state of the one contact spring 10 removed from the wire support guide 9. This figure illustrates a state of the contact spring 10 removed and placed on a flat table (not shown) in a natural state without application of external force.

As illustrated in this figure, the contact spring 10 is a single long and conductive component made of metal. According to this embodiment, the contact spring 10 is constituted by a bare wire not covered with insulating coating, produced by bending stainless steel wire of SUS 301 or the like or by other methods. The diameter of the wire is in a range from 0.1 mm to 1.0 mm, for example. Needless to say, the material of the contact spring 10 is not limited to SUS, but may be a hard steel wire, a piano wire, an oil tempered wire, or others.

The contact spring 10 includes contact portions 101 and 102 each of which is constituted by a coil spring. The contact portions 101 and 102 are disposed at one end and the other end of the contact spring 10 in the length direction of the contact spring 10. The contact spring 10 includes a plurality of linear portions 111, a plurality of bend-prearranged portions 112, and a plurality of bent portions 113, each of which portions 111 through 113 is formed between the one end and the other end of the contact spring 10 in the length direction.

The linear portions 111 are bare wire portions each of which is constituted by a not-processed linear stainless steel bare wire.

The bend-prearranged portions 112 are bare wire portions each of which is constituted by an extension coil spring produced from a linear stainless steel bare wire and wound in a spiral shape (coiling) in the length direction to have predetermined average coil diameter and pitch.

The linear portions 111 and the bend-prearranged portions 112 are alternately and continuously disposed. The respective bend-prearranged portions 112 are aligned with the linear portions 111, i.e., the axial center of the coil spring constituting each of the bend-prearranged portions 112 is aligned with the bear wire portions constituting the linear portions 111 disposed on both sides of the corresponding bend-prearranged portion 112 in the natural state of the respective portions 111 and 112 without application of external force.

The bent portions 113 are bare portions each of which is formed by bending a bare wire of linear stainless steel substantially at right angles.

Each of the bend-prearranged portions 112 and the bent portions 113 corresponds to a bent portion accommodated in a bent groove 92 (FIG. 6) of the wire support guide 9. According to this embodiment, the bend-prearranged portions 112 constituted by coil springs are located at three portions in the central portion in the length direction, while the bent portions 113 are located at remaining three portions.

Each of the bent portions located in the vicinity of the contact portions 101 and 102 at both ends is constituted by the bent portions 113 for the reason that variations produced by addition of dimensional tolerances at the respective bending positions do not easily increase at both ends in comparison with the variations produced by the bent portions in the central area in the length direction, and therefore do not easily cause problems in fitting the bent portions into a guide groove 90.

Moreover, the bent portion located second closest to the contact portion 102 is constituted by the bent portion 113 for the reason that coiling is difficult to perform when the interval (distance) between the bent portion 113 located closest to the contact portion 102 and the bent portion 113 located second closest to the contact portion 102 is excessively short.

Accordingly, when a distance between adjoining two bent portions included in the plurality of bent portions of the contact spring 10 is smaller than a predetermined value, in other words, a distance between the two adjoining bent grooves 92 is smaller than a predetermined value, bent portions (bare wire portions) to be accommodated in these two bent grooves 92 may be constituted by the bent portions 113. When no particular problems occur during manufacture of the contact spring 10 or on other occasions, all of the bent portions may be constituted by the bend-prearranged portions 112 corresponding to coil springs.

The contact portion 101 is a portion connected with a charging bias voltage output terminal or a developing bias voltage output terminal of the high-voltage power supply board 8, while the contact portion 102 is a portion connected with a charging bias voltage power receiving terminal of the charger 32 or a developing bias voltage power receiving terminal of the developing unit 33. The contact portions 101 and 102 have configurations processed similarly to the bend-prearranged portions 112.

According to this embodiment, each of the coil springs constituting the bend-prearranged portions 112 has a smaller average coil diameter than an average coil diameter of each of the coil springs constituting the contact portions 101 and 102. The difference in average coil diameter comes from the following reason. The output terminals of the high-voltage power supply board 8 and the power receiving terminals of the charger 32 and the developing unit 33 have relatively large areas for securing connection between the output terminals and the power receiving terminals. Accordingly, the average coil diameters of the contact portions 101 and 102 are increased in accordance with the enlarged areas of the output terminals and the power receiving terminals.

On the other hand, the width of the guide groove of the wire support guide 9 becomes shorter when an average coil diameter of each of the bend-prearranged portions 112 is small. In this case, a larger number of the plurality of guide grooves may be formed per unit area of the wire support guide 9. Accordingly, the wire support guide 9 small-sized in this manner is allowed to be positioned within a limited space of the apparatus body 2. Moreover, as the average coil diameter of each of the bend-prearranged portions 112 becomes larger, the cost rises with increase in a length of a linear material constituting the bend-prearranged portions 112. Accordingly, cost reduction is achievable when the average coil diameter is smaller.

Figure 4:
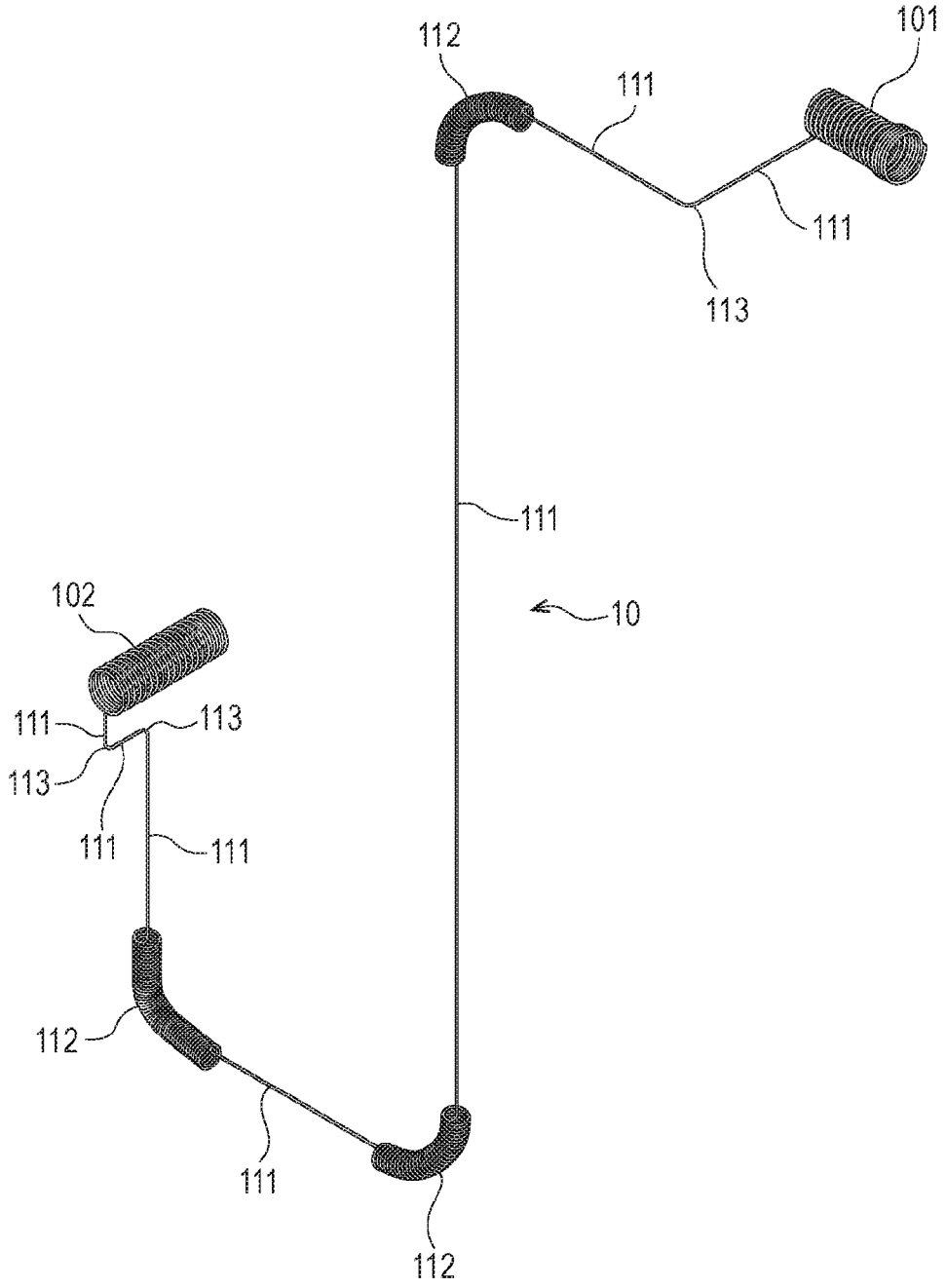
FIG. 4 is a perspective view illustrating a posture of the contact spring on the assumption that the contact spring is in a state attached to the wire support guide.

FIG. 4 is a perspective view illustrating a posture of the contact spring 10 on the assumption that the contact spring 10 is in a state attached to the wire support guide 9. Unlike the two-dimensional posture before attachment as illustrated in FIG. 3, the contact spring 10 illustrated in FIG. 4 is supported on the wire support guide 9 while elastically deformed into a three-dimensional posture where the three bend-prearranged portions 112, i.e., the coil spring forming portions are bent substantially at right angles.

The forming position, the average coil diameter, the total number of windings and the like of each of the bend-prearranged portions 112 constituted by coil springs, and the forming position, curvature, bending direction and the like of each of the bent portions 113 constituted by coil springs of the contact spring 10 are designed beforehand and manufactured based on the design such that the contact spring 10 can be fitted into a corresponding one of guide grooves 90*a* through 90*h* (FIG. 6) constituted by a part of the wire support guide 9.

Figure 5:
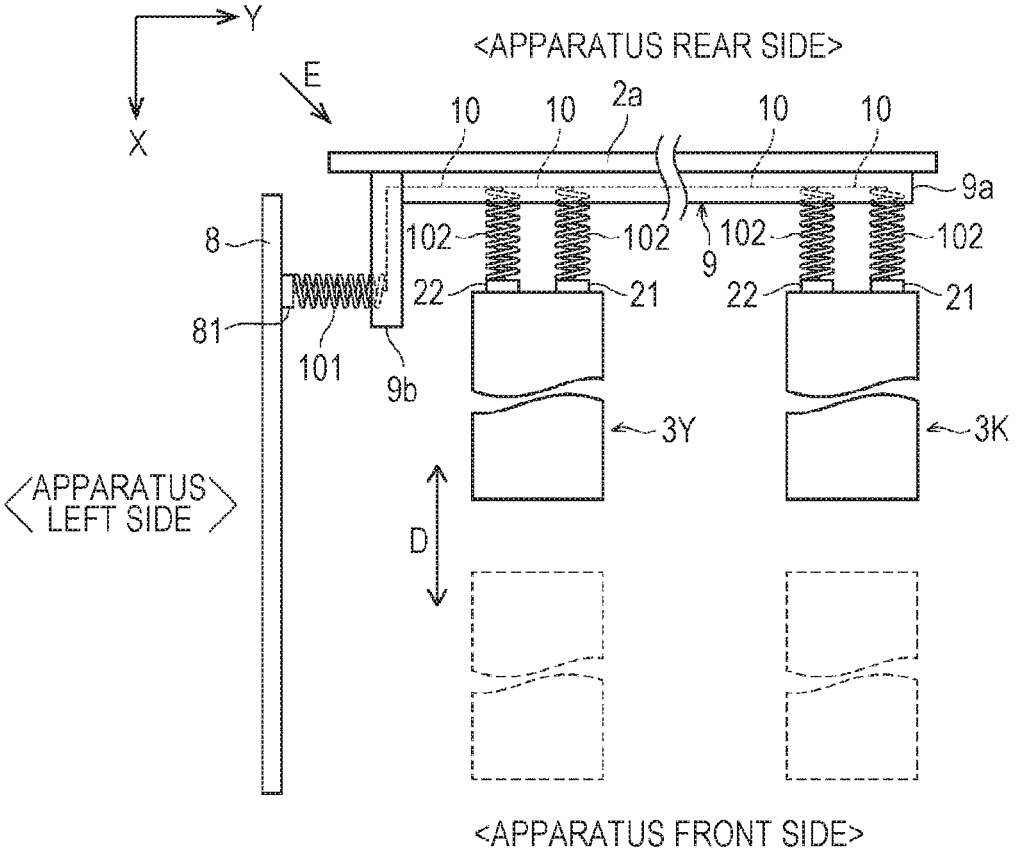
FIG. 5 is a schematic plan view illustrating a positional relationship between imaging units, a high-voltage power supply board, and the wire support guide to which the plurality of contact springs have been attached, as viewed from above the apparatus.

(4) Positional Relationship Between Imaging Units and High-Voltage Power Supply Board FIG. 5 is a schematic plan view illustrating a positional relationship between the imaging units 3Y and 3K, the high-voltage power supply board 8, and the wire support guide 9 to which the plurality of contact springs 10 have been attached, as viewed from above the apparatus. This figure does not show the imaging units 3M and 3K. In this figure, the front-rear direction of the apparatus corresponds to an X axis, while the left-right direction of the apparatus corresponds to a Y axis.

As illustrated in the figure, the wire support guide 9 attached to a frame 2*a* disposed on the rear side of the apparatus body includes a first support plate 9*a* elongated in the apparatus left-right direction (Y-axis direction), and a second support plate 9*b* extended in X-axis direction from the apparatus left end of the first support plate 9*a* toward the apparatus front side.

Each of the contact springs 10 (broken line) is supported between the first support plate 9*a* and the second support plate 9*b* of the wire support guide 9.

A power receiving terminal 21 of the charger 32 and a power receiving terminal 22 of the developing unit 33 are exposed on the apparatus rear side of the imaging unit 3Y. The contact portion 102 at one end of the one contact spring 10 is electrically connected with the power receiving terminal 21 of the charger 32, while the contact portion 102 at one end of the different contact spring 10 is electrically connected with the power receiving terminal 22 of the developing unit 33. Each of the contact portions 102 is constituted by a coil spring, and thus is constantly brought into contact with the power receiving terminal 21 or 22 by elastic urging force of the coil spring.

Similarly, the power receiving terminal 21 of the charger 32, or the power receiving terminal 22 of the developing unit 33 is electrically connected with the contact portion 102 at one end of the corresponding contact spring 10 for each of the other imaging units 3M through 3K.

Each of the imaging units 3Y through 3K is supported in a slot (not shown) formed in the apparatus body 2 in such a manner as to freely move into and out of the slot in an apparatus front-rear direction D along the X axis as illustrated in the figure. For example, a user is capable of removing the imaging unit 3Y disposed within the slot from the apparatus body 2 by pulling out the imaging unit 3Y toward the apparatus front side, and attaching the new imaging unit 3Y to the apparatus body 2 by pushing the new imaging unit 3Y toward the apparatus rear side into the slot. By this attachment, each of the power receiving terminals 21 and 22 of the new imaging unit 3Y is connected with the contact portion 102 of the corresponding contact spring 10. This applies to each of the other imaging units 3M through 3K.

The contact portion 101 at the other end of each of the contact springs 10 is electrically connected with an output terminal 81 of the high-voltage power supply board 8. Similarly to the contact portion 102, the contact portion 101 is constantly connected with the output terminal 81 by elastic urging force of the coil spring constituting the contact portion 101. The figure shows only the uppermost output terminal 81 of the plurality of output terminals 81 provided on the high-voltage power supply board 8 with clearances left between each other in the up-down direction.

(5) Configuration of Wire Support Guide

Figure 6:
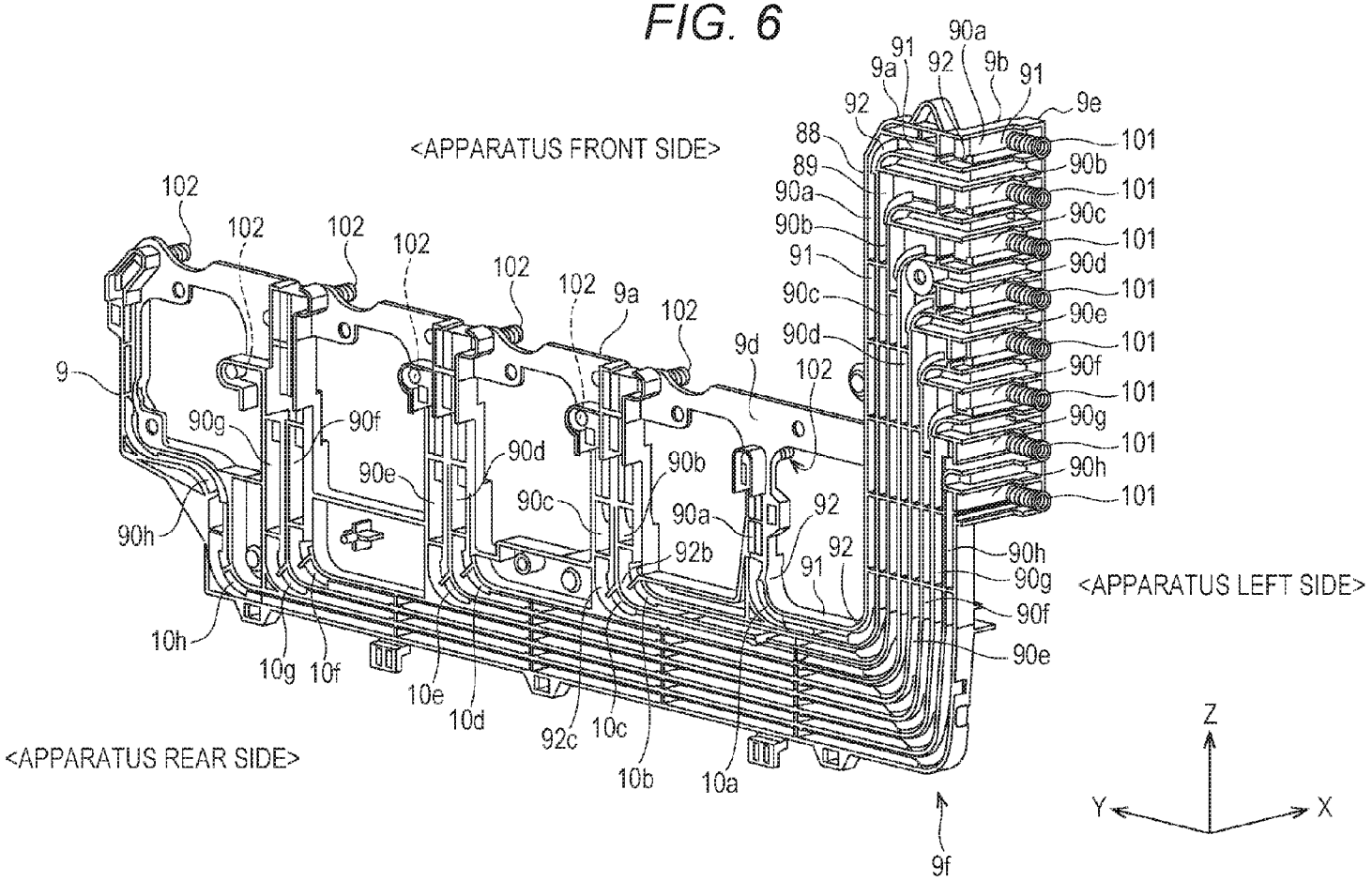
FIG. 6 is a perspective view of the wire support guide as viewed in a direction indicated by an arrow E in FIG. 5.

FIG. 6 is a perspective view of the wire support guide 9 as viewed in a direction indicated by an arrow E in FIG. 5, illustrating a state of the wire support guide 9 to which the eight contact springs 10 have been attached. In FIG. 6, eight contact springs 10*a* through 10*h* are illustrated for distinction between the respective contact springs 10. The imaging units 3Y through 3K, the high-voltage power supply board 8, and the frame 2*a* are not shown. The up-down direction corresponds to a Z axis in the figure.

As illustrated in FIG. 6, the first support plate 9*a* of the wire support guide 9 is a plate-shaped member extended in parallel with the Y-Z plane, while the second support plate 9*b* is a plate-shaped member extended in parallel with the X-Z plane. The eight guide grooves 90*a* through 90*h* are formed in a line on each of a surface 9*d* on the apparatus rear side of the first support plate 9*a*, and a surface 9*e* on the apparatus left side of the second support plate 9*b*. The contact springs 10*a* through 10*h* are accommodated in the guide grooves 90*a* through 90*h*, respectively, such that each of the contact springs 10*a* through 10*h* is accommodated in the corresponding guide groove to which an identical alphabetical symbol has been given.

In the following description, the contact springs 10*a* through 10*h* are collectively referred to as the contact springs 10 when distinction between the respective contact springs is not particularly necessary. Similarly, the guide grooves 90*a* through 90*h* are collectively referred to as the guide grooves 90 when distinction between the respective guide grooves is not particularly necessary.

Linear grooves 91 and bent grooves 92 are alternately formed in the route of the guide groove 90*a* between one end and the other end of the guide groove 90*a* in the length direction. This applies to each of the other guide grooves 90*b* through 90*h*. Hereinafter, the linear guide grooves 91 are referred to as linear grooves 91, and the bent guide grooves 92 are referred to as bent grooves 92.

The positions and curvatures of the respective bent grooves 92, and the lengths of the respective linear grooves 91 formed in the route are different for each of the guide grooves 90. Accordingly, forming positions of the linear portions 111, the bend-prearranged portions 112, and the bent portions 113 of each of the contact springs 10 to be accommodated in the corresponding guide groove 90 are determined beforehand in accordance with forming positions of the respective linear grooves 91 and the respective bent grooves 92 of the corresponding guide groove 90.

More specifically, the bend-prearranged portions 112 constituted by coil springs, or the bent portions 113 bent in correspondence with the bent shapes of the bent grooves 92 are formed beforehand at appropriate portions of a single bare wire corresponding to a wire material of the contact spring 10. The portions thus formed are portions to be accommodated in the respective bent grooves 92. The contact spring 10*a* accommodated in the uppermost guide groove 90*a* illustrated in the figure corresponds to the contact spring 10 illustrated in FIG. 4.

The respective contact portions 101 at one end of the respective contact springs 10 are disposed in a line with clearances left between each other in the up-down direction in a state accommodated in the corresponding guide grooves 90. While not shown in the figure, the respective output terminals 81 of the high-voltage power supply board 8 are similarly disposed in a line with clearances left between each other in the up-down direction. The positions of the respective contact portions 101 and the respective output terminals 81 in the up-down direction are determined beforehand such that the contact portions 101 are connected with the output terminals 81 in the same arrangement order in the up-down direction with one-to-one correspondence.

Each of the contact portions 102 corresponding to the other end of the contact spring 10 is projected toward the apparatus front side via a through hole (not shown) formed in the first support plate 9*a* of the wire support guide 9. This structure allows connection between the respective power receiving terminals 21 and 22 of the imaging units 3Y through 3K located on the apparatus front side of the wire support guide 9, and the contact portions 102 of the corresponding contact springs 10. In this case, the contact portion 101 at the one end corresponds to a voltage input terminal, while the contact portion 102 at the other end corresponds to a voltage output terminal for each of the contact springs 10. According to this example, the total number of windings and the average coil diameter of the coil spring of each of the contact portions 101 are uniform for each of the contact springs 10. This applies to the respective contact portions 102.

At the time of assembly in the manufacturing step of the printer 1, an operator fits and accommodates the respective contact portions 101 and 102, the linear portions 111, the bend-prearranged portions 112, and the bent portions 113 in the corresponding guide groove 90 in the order of the positions from one end to the other end of the contact spring 10 for each of the guide grooves 90 of the wire support guide 9. As a result, the one end of the contact spring 10 is connected with the high-voltage power supply board 8, while the other end of the contact spring 10 is connected with the charger 32 or the developing unit 33, via the linear grooves 91 and the bent grooves 92 of the guide groove 90.

Figure 7:
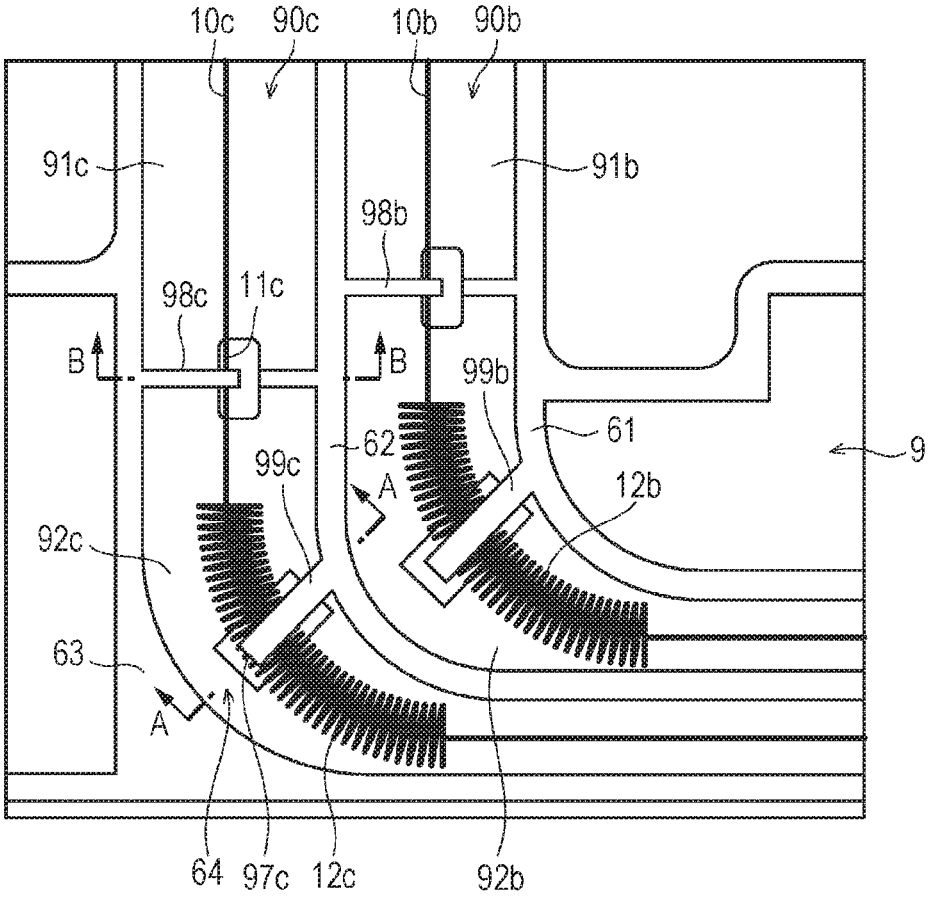
FIG. 7 is an enlarged view of bent grooves of the wire support guide as viewed from the apparatus rear side.
Figure 8A:
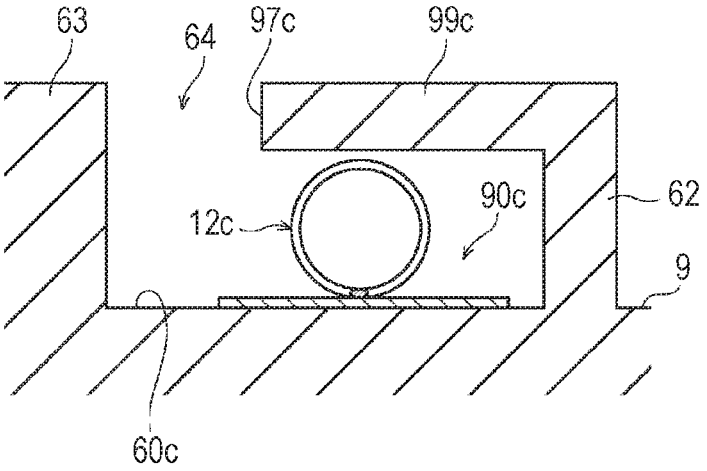

FIG. 7 is an enlarged view of bent grooves 92*b* and 92*c* of the guide grooves 90*b* and 90*c* formed in the first support plate 9*a* of the wire support guide 9 illustrated in FIG. 6, as viewed from the apparatus rear side. FIG. 8A is a cross-sectional view taken along a line A-A in FIG. 7, while FIG. 8B is a cross-sectional view taken along a line B-B in FIG. 7.

As illustrated in FIG. 7, a coil spring constituting a bend-prearranged portion 12*b* of the contact spring 10*b* is accommodated in the bent groove 92*b* of the guide groove 90*b*, while a coil spring constituting a bend-prearranged portion 12*c* of the contact spring 10*c* is accommodated in the bent groove 92*c* of the guide groove 90*c*. In the following description, the bend-prearranged portions are referred to as coil springs depending on situations.

The guide grooves 90*b* and 90*c* are separated by a common side wall 62. As illustrated in FIG. 8A, a projection 99*c* is formed on an upper part of the side wall 62 in a portion constituting the bent groove 92*c* of the guide groove 90*c*. The projection 99*c* projects toward an opposite side wall 63 of the guide groove 90*c* in a direction crossing the guide groove 90*c*. The coil spring 12*c* of the contact spring 10*c* is accommodated in a space formed between the projection 99*c* and a bottom surface 60*c* of the guide groove 90*c* while sandwiched between the projection 99*c* and the bottom surface 60*c* from above and below.

Figure 8B:
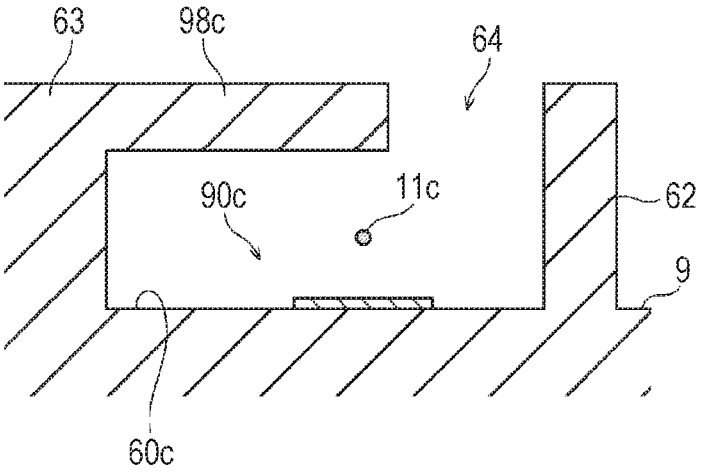
FIG. 8B is a cross-sectional view taken along a line B-B in FIG. 7.

Moreover, as illustrated in FIG. 8B, a projection 98*c* is formed on an upper part of the side wall 63 illustrated in FIG. 7 in a portion constituting the linear groove 91*c* of the guide groove 90*c*. The projection 98*c* projects toward the side wall 62 in a direction crossing the guide groove 90*c*. The linear portion 11*c* of the contact spring 10*c* is accommodated in a space formed between the projection 98*c* and the bottom surface 60*c* of the guide groove 90*c* while sandwiched from above and below.

The projections 98*c* and 99*c* press the portion of the contact spring 10*c* accommodated in the guide groove 90*c* to prevent rise and separation of the contact spring 10*c* from the guide groove 90*c* to the outside during the process for fitting and accommodating the contact spring 10*c* in the guide groove 90*c*. Accordingly, the projections 98*c* and 99*c* function as stoppers for preventing separation of the contact spring 10*c* from the guide groove 90*c*.

A clearance 64 longer than an outside diameter of the coil spring 12*c* is formed between the side wall 63 and a tip 97*c* of the projection 99*c* projecting from the side wall 62. Accordingly, the coil spring 12*c* of the contact spring 10*c* is allowed to be fitted through the clearance 64 to the guide groove 90*c* at the time of the assembly process.

This applies to the projection 98*c* projecting from the side wall 63. More specifically, the linear portion lic of the contact spring 10*c* is allowed to be fitted to the guide groove 90*c* through the clearance 64 formed between a tip of the projection 98*c* and the side wall 62.

Similarly, a projection 99*b* is formed on an upper part of a side wall 61 corresponding to one side wall of the guide groove 90*b* illustrated in FIG. 7 in a portion constituting the bent groove 92*b*. The projection 99*b* projects toward the opposite side wall 62 in a direction crossing the guide groove 90*b*. Moreover, a projection 98*b* is formed on an upper part of the side wall 62 in a portion constituting the linear groove 91*b* of the guide groove 90*b*. The projection 98*b* projects toward the side wall 61 in a direction crossing the guide groove 90*b*. The projections 98*b* and 99*b* function as stoppers for preventing separation of the contact spring 10*b* from the guide groove 90*b*.

As described above, the projection 98*b* and the projection 98*c* are provided only in the one linear groove 91*b* and the one linear groove 91*c* of the guide grooves 90*b* and 90*c*, respectively, while the projection 99*b* and the projection 99*c* are provided only in the one bent groove 92*b* and the one bent groove 92*c* of the guide grooves 90*b* and 90*c*, respectively. However, the projections 98*b* and 99*b* are provided similarly in the other linear grooves 91 and the other bent grooves 92. This applies to each of the other guide grooves 90*a* and 90*d* through 90*h*. The projections 98 and the projections 99 as projections for preventing separation of the contact spring 10 need not be provided in all of the linear grooves 91 and the bent grooves 92, respectively, for each of the guide grooves 90, but may be provided only in a portion from which the contact spring 10 is easily separated in the process for inserting the contact springs 10 by the operator. In addition, the projection 98 at least for the one linear groove 91 and the projection 99 at least for the one bent groove 92 may be both provided, or only either the projection 98 at least for the one linear groove 91 or the projection 99 at least for the one bent groove 92 may be provided for each of the guide grooves 90.

In the assembly process performed by the operator, the coil spring 112 provided on the contact spring 10 is accommodated for each of the bent grooves 92 in an elastically bent state in a posture bended in accordance with the shape of each of the bent grooves 92 for each of the guide grooves 90. The operator fits the coil spring 112 of the contact spring 10 into the corresponding bent groove 92 while bending the coil spring 112 from the linear posture into the posture corresponding to the shape of the bent groove 92.

The coil spring 112 has elasticity sufficient for expansion, contraction, and bend. Accordingly, even when the forming position of the coil spring 112 corresponding to the bend-prearranged portion is slightly shifted from the original design position due to a variation of the contact spring 10 at the time of manufacture, the operator is capable of easily fitting and accommodating the coil spring (bend prearranged portion) 112 in the bent groove 92 of the wire support guide 9 by slightly pulling the coil spring 112 while utilizing the elasticity of the coil spring 112 for expansion and contraction. This applies to each of the plurality of coil springs (bend-prearranged portions) 112 of the one contact spring 10.

Figure 9:
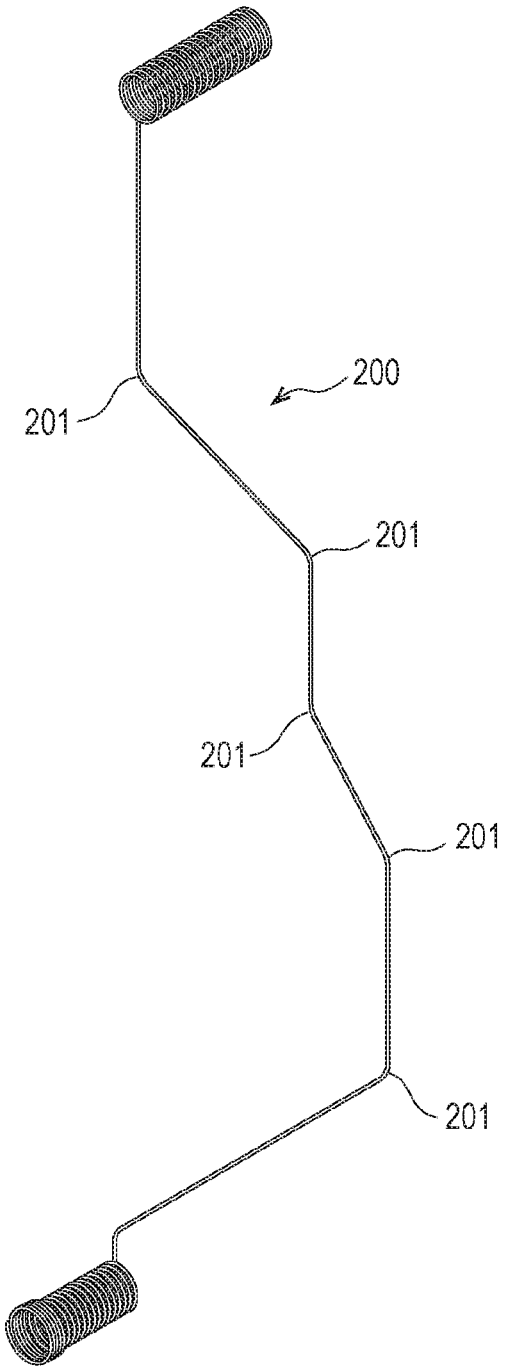
FIG. 9 is a view illustrating a configuration of a contact spring according to a comparison example.

In case of a contact spring 200 which includes bent portions 201 produced only by bending as illustrated in a comparison example of FIG. 9, the bent portions 201 formed at positions greatly deviated from the original positions due to variations at the time of manufacture are often difficult to be fitted even when the contact spring 200 is pulled by the operator, as described in the section of "Summary of the Invention". In this case, assembly efficiency lowers.

In comparison with this comparison example, the operator is capable of more easily fitting the contact spring 10 into the guide groove 90 according to this embodiment, wherefore assembly efficiency improves. Moreover, the projections 98 and 99 for preventing a rise of the contact spring 10 are provided for each of the guide grooves 90, wherefore the portion of the contact spring 10 accommodated in the guide groove 90 is not easily separated from the guide groove 90.

Figure 10:
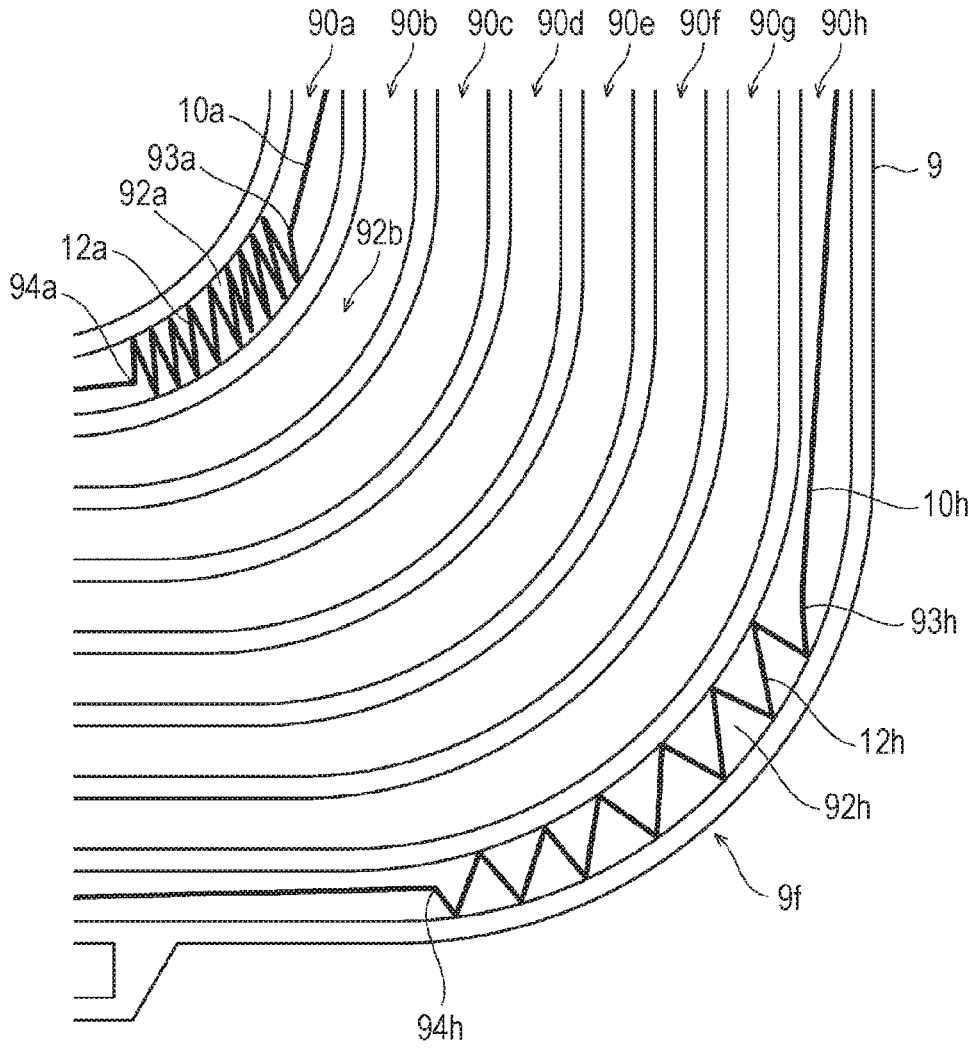
FIG. 10 is an enlarged view of a corner portion of a first support plate of the wire support guide as viewed from the apparatus rear side.

FIG. 10 is an enlarge view illustrating a corner portion 9*f* of the first support plate 9*a* of the wire support guide 9 illustrated in FIG. 6 as viewed from the apparatus rear side. As illustrated in FIG. 10, the contact spring 10*a* is accommodated in the guide groove 90*a* located on the innermost peripheral side in the guide grooves 90*a* through 90*h* bent and arranged in parallel at the corner portion 9*f*, while the contact spring 10*h* is accommodated in the guide groove 90*h* located on the outermost peripheral side. The contact springs 10*b* through 10*g* for the other guide grooves 90*b* through 90*g* are not shown.

Assuming that a total number of wirings of the coil spring 12*a* of the contact spring 10*a* accommodated in the bent groove 92*a* of the guide groove 90*a* is Wa, and that a total number of windings of the coil spring 12*h* of the contact spring 10*h* accommodated in the bent groove 92*h* of the guide groove 90*h* is Wh, Wa>Wh holds.

The difference in average coil diameter comes from the following reason. The bent groove 92*a* located on the inner peripheral side has a smaller radius of curvature (larger curvature) than a radius of curvature of the bent groove 92*h* located on the outer peripheral side, and thus produces a sharp bending. In this case, a bending angle for bending (warping) the coil spring 12*a* along the shape of the bending groove 92*a* increases in the fitting process of assembly by the operator. The larger bending angle requires larger force of the operator than a smaller angle, wherefore a burden imposed on the operator increases.

Assuming that all of a wiring material, a wiring diameter (cross-sectional area), a shape, and an average coil diameter of a coil spring are the same, force required for bending a coil spring at the same angle decreases when the number of windings is larger.

Accordingly, on the assumption that the relationship of the total number of windings Wa>Wh holds, the coil spring 12*a* requiring bending at a large angle is bended only by smaller force of the operator. In this case, the burden imposed on the operator at the time of fitting decreases, wherefore the assembly process is more easily performable.

The total number of windings Wh of the coil spring 12*h* may be increased similarly to the number of windings of Wa. However, the bent groove 92*h* on the outer peripheral side has a large radius of curvature and is more smoothly bended. In this case, the coil spring 12*h* is allowed to be bended by smaller force. Moreover, the length of the single wire material used for manufacture of the contact spring 10*h* increases as the total number of windings Wh becomes larger. In this case, the material cost further rises. Accordingly, it is preferable that the total number of windings Wh is determined based on comparison between the assembly efficiency for the operator and the material cost.

This applies to the other contact springs 10*b* through 10*g*. More specifically, the radius of curvature increases in the order from the guide groove 90*a* to the guide groove 90*h*, wherefore a relationship of Wa>Wb>Wh holds on the assumption that a total number of windings of the coil spring 112 of the contact spring 10*b* accommodated in the bent groove 92*b* of the guide groove 90*b* is Wb.

Assuming that a total number of windings of each of the coil springs 112 accommodated in the bent groove 92 having a first radius of curvature R1 is W1, and that a total number of windings of each of the coil springs 112 accommodated in the bent groove 92 having a second radius of curvature R2 (>R1) is W2 for each of the contact springs 10*a* through 10*h*, the total number of windings of each of the coil springs 112 for each of the contact springs 10*a* through 10*h* may be determined such that a relationship of W1>W2 holds. The description of the bent grooves 92*a* through 92*h* at the corner portion 9*f* illustrated in FIG. 10 is applicable to the other bent grooves, such as the bent grooves 92*b* and 92*c* (FIG. 6).

In the example described herein, the number of windings W of each of the coil springs 112 is varied for each of the bent grooves 92 of the plurality of guide grooves 90 disposed in parallel at the one corner portion (corner portion) 9*f* in accordance with the curvatures of the respective bent grooves 92. However, other configurations are adoptable. For example, this structure is applicable to the coil springs 112 accommodated in the bent grooves 92 having different curvatures in the plurality of bent grooves 92 of the one guide groove 90. More specifically, the total number of windings W of the coil spring 112 accommodated in the bent groove 92 having a small radius of curvature (large curvature) in the plurality of bend-prearranged portions (coil springs) 112 of the one contact spring 10 may be made larger than the total number of windings W of the coil spring 112 accommodated in the bent groove 92 having a large radius of curvature (small curvature) in the plurality of bend-prearranged portions (coil springs) 112 of the same contact spring 10.

The relationship between the total numbers of the coil springs W1 and W2 have been discussed on the assumption that the number of windings per unit length (corresponding to pitch) is uniform. However, other configurations are adoptable.

For example, the total numbers of windings Wa and Wh may be equivalent, and a pitch Pa of the coil spring 12*a* may be smaller than a pitch Ph of the coil spring 12*h* in the natural state without application of external force under the condition that a length (developed length) La from one end 93*a* to an opposite end 94*a* of a wire material constituting the coil spring 12*a* of the contact spring 10*a* is equivalent (or substantially equivalent) to a developed length Lh from one end 93*h* to an opposite end 94*h* of a wire material constituting the coil spring 12*h* of the contact spring 10*h* in FIG. 10. Under the relationship of the pitch Pa<Ph, the coil spring 12*a* of the contact spring 10*a* is easily fitted into the bent groove 92*a* having a smaller radius of curvature.

In the condition that the developed length La of the coil spring 12*a* of the contact spring 10*a* is equivalent to the developed length Lh of the coil spring 12*h* of the contact spring 10*h*, electric resistances of the coil springs 12*a* and 12*h* are uniform when the wire materials and the wire diameters (cross-sectional areas) are the same.

Assuming that input voltages and currents at the respective contact portions 101 are equivalent for the contact springs 10*a* and 10*h*, the amounts of voltage drops produced at the respective coil springs 12*a* and 12*h* become uniform. In this case, a large difference between output voltages at the respective contact portions 102 is not produced at least as a result of a difference in the amounts of voltage drops produced at the respective coil springs 12*a* and 12*h* when the entire lengths of the contact springs 10*a* and 10*h* are substantially equivalent. This applies to the other coil springs 12*a* and 12*h* of the contact springs 10*a* and 10*h*.

More specifically, when the bend-prearranged portions 112 of the contact spring 10 are constituted by coil springs as in this embodiment, a longer bare wire by an amount of a spiral shape is needed in comparison with the structure which uses a linear bare wire including portions only bended at predetermined angles as illustrated in the comparison example (FIG. 9). The increased wire length raises an electric resistance, wherefore the structure is more easily affected by voltage drops. Accordingly, a difference may be produced between the output voltages from the contact portions 102 of the different contact springs 10 even in the state of an equivalent voltage input to the contact portions 101, even though the difference is small.

For overcoming this problem, the difference in the output voltages produced by voltage drops caused in the coil springs 112 is reduced as much as possible for each of the contact springs 10 by equalizing the electric resistances at the portions of the coil springs 112 of the different contact springs 10.

For example, assuming that the entire lengths of the different contact springs 10 are substantially equivalent in a structure supplying the same charging bias voltage to each of the imaging units 3Y through 3K, the difference in the voltages supplied to the imaging units 3Y through 3K from the respective contact springs 10 is decreased substantially to none by equalizing the charging bias voltages input to the respective contact springs 10 from the high-voltage power supply board 8, even when a certain voltage drop is produced in accordance with current flow in the coil spring 112 for each of the contact springs 10. Accordingly, stable supply of a charging bias voltage is achievable. This applies to the developing bias voltage.

Figure 11:
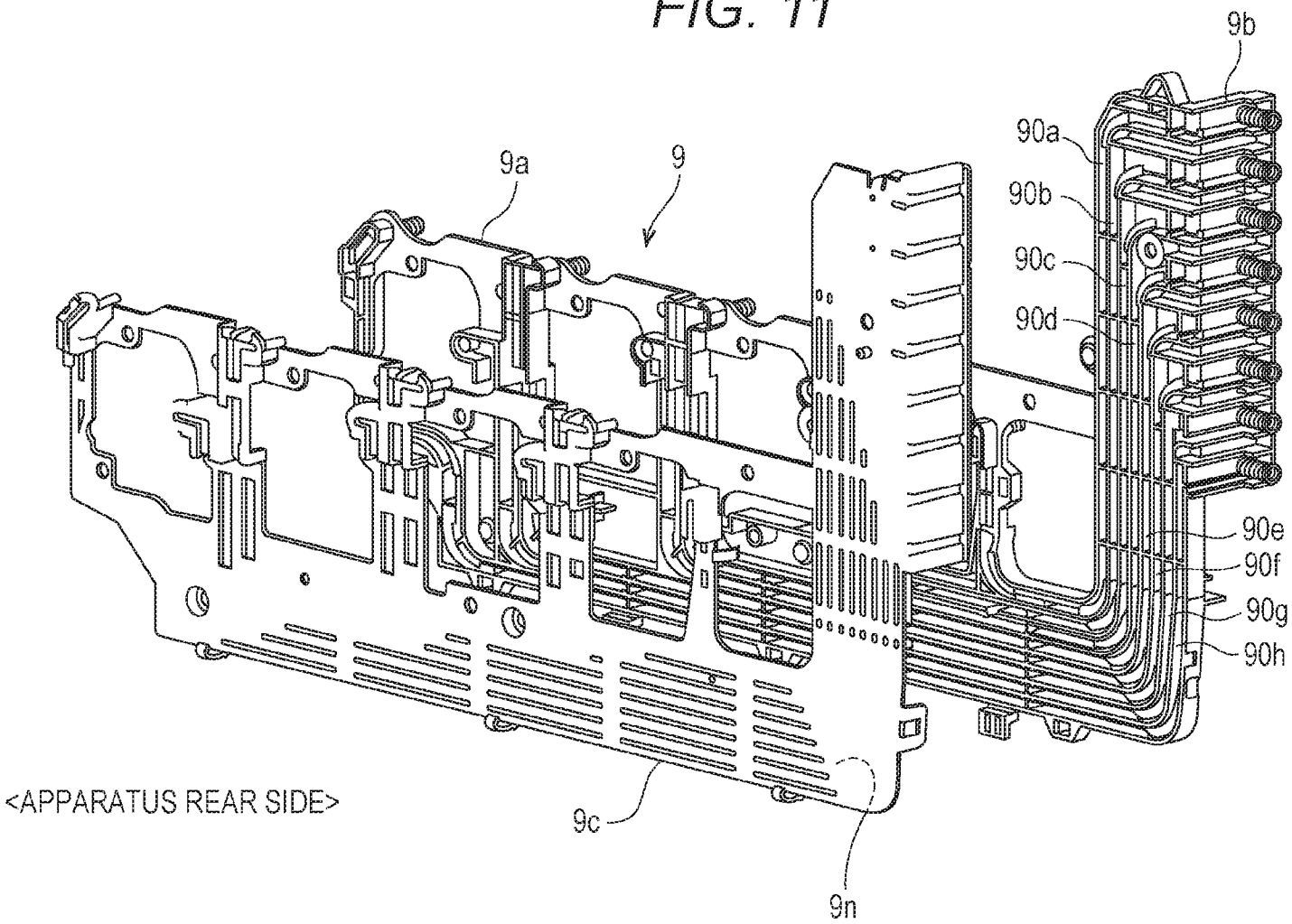
FIG. 11 is a perspective view illustrating attachment of a cover to the wire support guide to close guide grooves.

FIG. 11 is a perspective view illustrating attachment of a cover 9*c* to the wire support guide 9 for closing the guide grooves 90*a* through 90*h* of the wire support guide 9. The cover 9*c* is attached to the wire support guide 9 by screws or the like.

When the cover 9*c* illustrated in the figure is attached to the wire support guide 9, a surface 9*n* of the cover 9*c* facing the wire support guide 9 covers and closes the guide grooves 90*a* through 90*h* of the wire support guide 9 from the apparatus rear side and the apparatus left side. The attached cover 9*c* prevents separation of the contact springs 10*a* through 10*h* accommodated in the guide grooves 90*a* through 90*h* to the outside from the guide grooves 90*a* through 90*h*.

As described above, the contact spring 10 according to this embodiment includes the bend-prearranged portions 112 constituted by coil springs as portions accommodated in the bent grooves 92 of the wire support guide 9. In this case, the coil springs corresponding to the bend-prearranged portions are bended by elastic deformation at the time of the insertion process of the contact spring 10 into the guide groove 90 of the wire support guide 9 by the operator during the manufacture step of the printer 1. Accordingly, the contact spring 10 is easily fitted into the bent grooves 92 of the guide groove 90, wherefore assembly efficiency improves in comparison with the comparison example (FIG. 9) including only the bent portions.

Moreover, the contact spring 10 includes the bent prearranged portions 112 which are linear and not bended in the natural state without application of external force before accommodated in the guide groove 90 as illustrated in FIG. 3. In this state, the prearranged portions 112 and the linear portions 111 form a linear shape for the entire length.

Accordingly, the linear contact spring 10 may be inserted into an easy and low-cost long package bag made of plastics or the like for management within a warehouse, or for carrying to the outside. When a number of contact springs 10 each formed in a linear shape are bound and stored, reduction of a space required for storage, and resultant reduction of the management cost are achievable.

Modified Examples

While the specific embodiment of the present invention has been described and depicted, it should be understood as an explicit matter that the present invention is not limited to the embodiment presented herein. Various modifications including the followings may be made.

Figure 12:
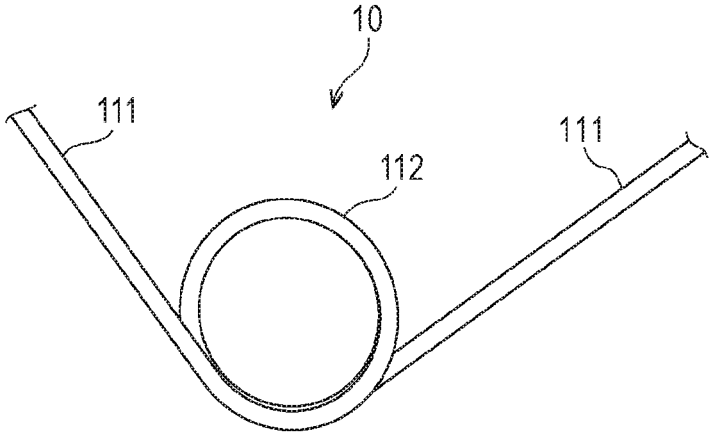
FIG. 12 is a view illustrating a configuration of a bend-prearranged portion of a contact spring according to a modified example.

(1) According to the configuration example of the embodiment described herein, each of the bend-prearranged portions 112 of the contact spring 10 is constituted by a coil wound in a spiral shape in the length direction. However, each of the bend-prearranged portions 112 may be constituted by other types of elastic portion allowing expansion, contraction, and bend. For example, each of the bend-prearranged portions 112 of the contact spring 10 may be constituted by a torsion coil spring as illustrated in FIG. 12. The number of windings of the torsion coil spring may be one or two, for example.

Each of the bend-prearranged portions 112 is not limited to a coil, but may be a zigzag-shaped member in the length direction.

According to the configuration example described herein, the one contact spring 10 includes the plurality of bend-prearranged portions 112 constituted by coils. However, other configurations are adoptable. When one or more bent grooves 92 are present in the guide groove 90 of the wire support guide 9, a coil-shaped or zigzag-shaped elastic portion formed at a bare wire portion accommodated in the corresponding bent groove 92 may be provided for each of all the bent grooves 92, or for any one or a plurality of the bent grooves 92.

(2) According to the embodiment described herein, the contact spring 10 is processed to have a linear shape in the natural state without application of external force before accommodated in the guide groove 90. However, other configurations are adoptable. For example, each of the bend-prearranged portions 112 of the contact spring 10 may have a shape curved along the bent groove 92 of the guide groove 90 in the natural state without application of external force before accommodated in the guide groove 90.

In this case, however, the entire shape of the contact spring 10 may become complicated, such as an L shape for one bent portion, and a U shape or a three-dimensional shape for two or more bent portions. However, the contact spring 10 is allowed to obtain a shape corresponding to the route of the guide groove 90 before accommodation. Accordingly, the operator is not required to bend the bend-prearranged portions 112 of the contact spring 10 into shapes along the bent grooves 92 of the guide groove 90 while applying force to the contact spring 10 during the manufacture step, wherefore the fitting process is easily performable.

(3) According to the embodiment described herein, the average coil diameter of each of the coil springs constituting the bend-prearranged portions 112 of the contact spring 10 is smaller than the average coil diameter of each of the coil springs constituting the contact portions 101 and 102. However, other configurations are adoptable. The average coil diameters of the coil springs of the bend-prearranged portions 112 and the contact portions 101 and 102 may be uniform, or may have an opposite length relationship.

The total numbers of windings of the coil springs W1 and W2, the pitches Pa and Ph, the developed length Lh and the like may have other length relationships. For example, the total numbers of windings W1 and W2 may be made uniform in accordance with the apparatus configuration.

According to the embodiment, the contact portions 101 and 102 at both ends of the contact spring 10 are constituted by coils. However, other configurations are adoptable. Only the contact portion at one end of the contact spring 10 may be formed into an elastic portion constituted by a coil spring or a zigzag-shaped member, or the contact portions at both ends may be constituted by linear members without processing, for example. The contact portions at both ends of the contact spring 10 may be arbitrarily structured as long as the contact portions are connectable with the output terminal 81 of the high-voltage power supply board 8, and the corresponding one of the power receiving terminals 21 and 22 of the imaging units 3Y through 3K.

(4) According to the embodiment described herein, the cover 9*c* is attached to the wire support guide 9. However, other configurations are adoptable. For example, the cover 9*c* may be eliminated when a plurality of the projections 98 and 99 are formed in the guide groove 90 of the wire support guide 9 at regular intervals in the length direction of the guide groove 90 for preventing separation of the contact spring 10 to the outside of the guide groove 90.

A configuration eliminating the projections 98 and 99 may be adopted. More specifically, when the portions of the contact spring 10 fitted into the guide groove 90 of the wire support guide 9 do not easily rise and separate from the guide groove 90 during the process for fitting the contact spring 10 into the guide groove 90 of the wire support guide 9, separation of the contact spring 10 from the guide groove 90 may be prevented not by the projections 98 and 99, but by the cover 9*c*.

(5) According to the embodiment described herein, the contact spring 10 is used as wiring for supplying the charging bias voltage and developing bias voltage output from the high-voltage power supply board 8 to the imaging units 3Y through 3K. However, other configurations are adoptable. For example, in case of a configuration which supplies power from the high-voltage power supply board 8 to a heater of the fixation unit 6, the embodiment is applicable to wiring for supplying this power In addition, the unit for power supply is not limited to the high-voltage power supply board 8, but may be other power supply units such as other types of power supply board. Similarly, the units for power reception are not limited to the imaging units 3Y through 3K and the fixation unit 6, but may be other units such as a motor. In case of the high-voltage power supply board 8 equipped with the plurality of output terminals 81, each of the output terminals 81 may be regarded as a power supply unit (part).

The embodiment is applicable to an ordinary contact spring constituted by a bare wire for non-linearly connecting two components disposed apart from each other within an image forming apparatus such as the printer 1.

According to the embodiment described herein, substantially the entire part of the single contact spring 10 is accommodated in the one guide groove 90. However, other configurations are adoptable.

For example, the linear portions 111 of the contact spring 10 may be supported not by the guide groove 90. More specifically, the side walls 88 and 89 constituting the linear grooves 91 of the guide groove 90*a* illustrated in FIG. 6 may be removed. In this case, only the bent portions (bend-prearranged portions 112 and the bent portions 113) of the contact spring 10 are supported by the bended grooves 92.

(6) According to the embodiment described herein, the configuration example of the tandem-type color printer has been discussed as an example of the image forming apparatus. However, other configurations are adoptable. The image forming apparatus may be a printer capable of forming only monochrome images. In addition, the image forming apparatus is not limited to an electrophotographic printer, but may be an inkjet printer, for example. Moreover, the embodiment is applicable to other ordinary image forming apparatuses, such as a copy machine, a facsimile machine, and an MFP (multiple function peripheral).

The shape of the contact spring 10, the forming portions and the numbers of the bend-prearranged portions 112 and the bent portions 113, the shapes, routes, lengths, and the number of the guide grooves 90 of the wire support guide 9 are not limited to the specific examples described herein, but may be determined beforehand as shapes and the like appropriate for the apparatus configuration.

Any possible combinations of the contents of the embodiment and modified examples are allowable. Mechanisms of respective units or respective components may be replaced with other mechanisms or units having different shapes within the scope offering the advantages of the present invention.

The present invention is applicable to a contact spring included in an image forming apparatus.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A contact spring constituted by a bare wire and accommodated in a bent groove of a wire support guide, configured to realize non-linear connection via the bare wire between two parts disposed apart from each other within an image forming apparatus, in such a manner that one end of the contact spring is connected with one of the two parts, and an other end of the contact spring is connected with the other part via the bent groove, the contact spring comprising a coil-shaped or zigzag-shaped elastic portion of the bare wire in a portion accommodated in the bent groove, wherein the elastic portion is fit into the bent groove, and is supported in the bent groove while being elastically bent by an external force from the bent groove, and wherein portions of the contact spring on both sides of the elastic portion are linear and aligned with an axial center of the elastic portion in a line in a natural state without application of external force.

2. The contact spring according to claim 1, wherein the wire support guide includes three or more bent grooves, and portions of the contact spring accommodated in two of the three or more bent grooves not including the bent groove in which the elastic portion is accommodated are bent beforehand in accordance with bent shapes of the two of the three or more bent grooves.

3. The contact spring according to claim 1, wherein at least one end of the contact spring is a coil-shaped end, and connects with the corresponding part by elastic urging force.

4. The contact spring according to claim 3, wherein the elastic portion is a coil wound in a spiral shape, and an average coil diameter of the elastic spiral portion is smaller than an average coil diameter of the coil-shaped end.

5. The contact spring according to claim 1, wherein the wire support guide includes three or more bent grooves, and when a distance between two adjoining bent grooves of the three or more bent grooves and not including the bent groove in which the elastic portion is accommodated is shorter than a predetermined value, portions of the contact spring accommodated in each of the two adjoining bent grooves are bent beforehand in accordance with a bent shape of the corresponding bent groove.

6. An image forming apparatus comprising:

two parts associated with image formation; and the contact spring according to claim 1, wherein one end of the contact spring is connected with one of the two parts, and the other end of the contact spring is connected with the other part via the bent groove.

7. The image forming apparatus according to claim 6, wherein a plurality of pairs of parts are provided, a plurality of contact springs are provided for the plurality of pairs in one-to-one relationship, the wire support guide includes a plurality of bent grooves separately for each of the plurality of pairs, a first bent groove and a second bent groove included in the plurality of bent grooves are disposed in parallel with each other in a state that a curvature of the first bent groove is larger than a curvature of the second bent groove, an elastic portion of a first contact spring is accommodated in the first bent groove, while an elastic portion of a second contact spring is accommodated in the second bent groove, each of the elastic portions of the first and second contact springs is a coil wound in a spiral shape, and a total number of windings of the elastic spiral portion of the first contact spring is larger than a total number of windings of the elastic spiral portion of the second contact spring.

8. The image forming apparatus according to claim 6, wherein a plurality of pairs of parts are provided, a plurality of contact springs are provided for the plurality of pairs in one-to-one relationship, the wire support guide includes a plurality of bent grooves separately for each of the plurality of pairs, a first bent groove and a second bent groove included in the plurality of bent grooves are disposed in parallel with each other in a state that a curvature of the first bent groove is larger than a curvature of the second bent groove, an elastic portion of a first contact spring is accommodated in the first bent groove, while an elastic portion of a second contact spring is accommodated in the second bent groove, and each of the elastic portions of the first and second contact springs is a coil wound in a spiral shape, and a total number of windings of the coil of the elastic spiral portion of the first contact spring is equivalent to a total number of windings of the coil of the elastic spiral portion of the second contact spring, with a smaller pitch of the coil of the elastic spiral portion of the first contact spring than a pitch of the coil of the elastic spiral portion of the second contact spring.

9. The image forming apparatus according to claim 6, wherein the wire support guide includes a plurality of bent grooves, the contact spring connecting the two parts via the plurality of bent grooves includes the elastic portion in each of portions of the bare wire accommodated in the respective bent grooves, a curvature of a first bent groove included in the plurality of bent grooves is larger than a curvature of a second bent groove included in the plurality of bent grooves, a first elastic portion included in the plurality of elastic portions of the single contact spring is accommodated in the first bent groove, while a second elastic portion included in the plurality of elastic portions of the single contact spring is accommodated in the second bent groove, each of the first and second elastic portions is a coil wound in a spiral shape, and a total number of windings of the first elastic spiral portion is larger than a total number of windings of the second elastic spiral portion.

10. The image forming apparatus according to claim 6, further comprising a projection disposed in the bent groove of the wire support guide to prevent rise and separation of the contact spring accommodated in the bent groove to the outside from the bent groove.

11. The image forming apparatus according to claim 6, further comprising:

an image carrier;

a charger that charges the image carrier;

an exposure unit that applies optical beams to the charged image carrier to form an electrostatic latent image;

a developing unit that develops the electrostatic latent image formed on the image carrier by using developer; and a power supply unit that supplies a bias voltage to each of the charger and the developing unit, wherein one of the parts corresponds to the power supply unit, and the other part corresponds to the charger or the developing unit.

12. The image forming apparatus according to claim 6, wherein the elastic portion is formed in a coil shape in which the elastic portion is repeatedly wound in the extending direction of the contact spring, or is formed in a zigzag shape in which the elastic portion is repeatedly bent in the extending direction of the contact spring.

13. The contact spring according to claim 1, wherein the elastic portion is formed in a coil shape in which the elastic portion is repeatedly wound in the extending direction of the contact spring, or is formed in a zigzag shape in which the elastic portion is repeatedly bent in the extending direction of the contact spring.

* * * * *